US009442436B1

(12) United States Patent
Umeno

(10) Patent No.: US 9,442,436 B1
(45) Date of Patent: Sep. 13, 2016

(54) IMAGE FORMING APPARATUS AND CONVEYANCE SPEED CONTROL METHOD

(71) Applicant: KONICA MINOLTA, INC., Chiyoda-ku, Tokyo (JP)

(72) Inventor: Hideyuki Umeno, Sagamihara (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/016,532

(22) Filed: Feb. 5, 2016

(30) Foreign Application Priority Data

Mar. 2, 2015 (JP) ..... 2015-039742

(51) Int. Cl.
*G03G 15/20* (2006.01)

(52) U.S. Cl.
CPC ..... *G03G 15/2028* (2013.01)

(58) Field of Classification Search
USPC ..... 399/33, 38, 42–44, 67–69, 123, 320, 399/328, 329
See application file for complete search history.

(56) References Cited

U.S. PATENT DOCUMENTS 5,701,554 A * 12/1997 Tanaka ..... G03G 15/2039 399/69
2014/0286665 A1* 9/2014 Minagawa ..... G03G 15/2017 399/69
2014/0286666 A1* 9/2014 Sasaki ..... G03G 15/2039 399/69

FOREIGN PATENT DOCUMENTS

JP 8-286551 A 11/1996
JP 9-305056 A 11/1997
JP 2009-276580 A 11/2009
JP 2013-246404 A 12/2013

* cited by examiner

*Primary Examiner* — Hoan Tran
(74) *Attorney, Agent, or Firm* — Buchanan Ingersoll & Rooney PC

(57) ABSTRACT

An image forming apparatus includes: an intermediate transfer belt to which a toner image is transferred in a primary transfer process; a transfer roller configured to transfer the toner image onto a long paper sheet in a secondary transfer process by following rotation of the intermediate transfer belt when pressed by the intermediate transfer belt; and a fixing device configured to fix the toner image transferred in the secondary transfer process by the transfer roller, onto the paper sheet; a temperature estimating unit; and a speed control unit, wherein the fixing device includes: a heating conveyance roller provided on a lower surface side of the paper sheet; and a fixing roller provided on an upper surface side of the paper sheet, the fixing roller facing the heating conveyance roller.

9 Claims, 11 Drawing Sheets

FIG. 7

| PAPER TYPE | BASIS WEIGHT | THICKNESS | PAPER TYPE | BASIS WEIGHT | THICKNESS | PAPER TYPE | BASIS WEIGHT | THICKNESS |
|---|---|---|---|---|---|---|---|---|
| PLAIN PAPER | 62–74g/m² | 0.068 | TACK PLAIN PAPER | 62–74g/m² | 0.068 | PP FILM | 62–74g/m² | 0.068 |
| | 75–80g/m² | 0.078 | | 75–80g/m² | 0.078 | | 75–80g/m² | 0.078 |
| | 81–91g/m² | 0.085 | | 81–91g/m² | 0.085 | | 81–91g/m² | 0.085 |
| | 92–105g/m² | 0.095 | | 92–105g/m² | 0.095 | | 92–105g/m² | 0.095 |
| | 106–135g/m² | 0.15 | | 106–135g/m² | 0.15 | | 106–135g/m² | 0.15 |
| | 136–176g/m² | 0.156 | | 136–176g/m² | 0.156 | | 136–176g/m² | 0.156 |
| | 177–216g/m² | 0.195 | | 177–216g/m² | 0.195 | | 177–216g/m² | 0.195 |
| | 217–256g/m² | 0.235 | | 217–256g/m² | 0.235 | | 217–256g/m² | 0.235 |
| | 257–300g/m² | 0.28 | | 257–300g/m² | 0.28 | | 257–300g/m² | 0.28 |
| COATED PAPER G | 62–74g/m² | 0.068 | TACK COATED PAPER G | 62–74g/m² | 0.068 | PET FILM | 62–74g/m² | 0.068 |
| | 75–80g/m² | 0.078 | | 75–80g/m² | 0.078 | | 75–80g/m² | 0.078 |
| | 81–91g/m² | 0.085 | | 81–91g/m² | 0.085 | | 81–91g/m² | 0.085 |
| | 92–105g/m² | 0.095 | | 92–105g/m² | 0.095 | | 92–105g/m² | 0.095 |
| | 106–135g/m² | 0.15 | | 106–135g/m² | 0.15 | | 106–135g/m² | 0.15 |
| | 136–176g/m² | 0.156 | | 136–176g/m² | 0.156 | | 136–176g/m² | 0.156 |
| | 177–216g/m² | 0.195 | | 177–216g/m² | 0.195 | | 177–216g/m² | 0.195 |
| | 217–256g/m² | 0.235 | | 217–256g/m² | 0.235 | | 217–256g/m² | 0.235 |
| | 257–300g/m² | 0.28 | | 257–300g/m² | 0.28 | | 257–300g/m² | 0.28 |
| COATED PAPER M | 62–74g/m² | 0.068 | TACK COATED PAPER M | 62–74g/m² | 0.068 | TACK PP FILM | 62–74g/m² | 0.068 |
| | 75–80g/m² | 0.078 | | 75–80g/m² | 0.078 | | 75–80g/m² | 0.078 |
| | 81–91g/m² | 0.085 | | 81–91g/m² | 0.085 | | 81–91g/m² | 0.085 |
| | 92–105g/m² | 0.095 | | 92–105g/m² | 0.095 | | 92–105g/m² | 0.095 |
| | 106–135g/m² | 0.15 | | 106–135g/m² | 0.15 | | 106–135g/m² | 0.15 |
| | 136–176g/m² | 0.156 | | 136–176g/m² | 0.156 | | 136–176g/m² | 0.156 |
| | 177–216g/m² | 0.195 | | 177–216g/m² | 0.195 | | 177–216g/m² | 0.195 |
| | 217–256g/m² | 0.235 | | 217–256g/m² | 0.235 | | 217–256g/m² | 0.235 |
| | 257–300g/m² | 0.28 | | 257–300g/m² | 0.28 | | 257–300g/m² | 0.28 |
| PP (SYNTHETIC PAPER) | 62–74g/m² | 0.068 | TACK PP (SYNTHETIC PAPER) | 62–74g/m² | 0.068 | TACK PET FILM | 62–74g/m² | 0.068 |
| | 75–80g/m² | 0.078 | | 75–80g/m² | 0.078 | | 75–80g/m² | 0.078 |
| | 81–91g/m² | 0.085 | | 81–91g/m² | 0.085 | | 81–91g/m² | 0.085 |
| | 92–105g/m² | 0.095 | | 92–105g/m² | 0.095 | | 92–105g/m² | 0.095 |
| | 106–135g/m² | 0.15 | | 106–135g/m² | 0.15 | | 106–135g/m² | 0.15 |
| | 136–176g/m² | 0.156 | | 136–176g/m² | 0.156 | | 136–176g/m² | 0.156 |
| | 177–216g/m² | 0.195 | | 177–216g/m² | 0.195 | | 177–216g/m² | 0.195 |
| | 217–256g/m² | 0.235 | | 217–256g/m² | 0.235 | | 217–256g/m² | 0.235 |
| | 257–300g/m² | 0.28 | | 257–300g/m² | 0.28 | | 257–300g/m² | 0.28 |

IMAGE FORMING APPARATUS AND CONVEYANCE SPEED CONTROL METHOD

The entire disclosure of Japanese Patent Application No. 2015-039742 filed on Mar. 2, 2015 including description, claims, drawings, and abstract are incorporated herein by reference in its entirety.

BACKGROUND OF THE INVENTION

1. Field of the Invention

The present invention relates to an image forming apparatus and a conveyance speed control method.

2. Description of the Related Art

There have been electrophotographic image forming apparatuses. An electrophotographic image forming apparatus forms a toner image by developing an electrostatic latent image formed on a photosensitive drum, transfers the formed toner image onto a paper sheet, and heats and fixes the transferred toner image, to form an image on the paper sheet.

When a long paper sheet (such as roll paper) is conveyed in an electrophotographic image forming apparatus, if a paper loop is formed between rollers provided in the conveyance path, the paper sheet is allowed to be in any position. As a result, paper wrinkling or meandering occurs. Therefore, the rollers provided closer to the downstream side of the conveyance path are designed to rotate at higher linear speeds, so that tension is applied to the paper sheet, and paper wrinkling and meandering are prevented.

When a printing process is performed in the above described image forming apparatus, a paper sheet is heated to a high temperature by the fixing device, and an image is fixed onto the paper sheet. Therefore, the heating conveyance roller of the fixing device thermally expands or contracts, and the outer diameter of the heating conveyance roller changes. During printing, for example, the temperature of the heating conveyance roller gradually increases, and thermal expansion occurs. The outer diameter of the heating conveyance roller becomes larger accordingly. As a result, the conveyance speed of the fixing device gradually becomes higher with respect to the conveyance speed of the transfer unit provided on the upstream side in the conveying direction.

As the conveyance speed of the fixing device becomes higher with respect to the conveyance speed of the transfer unit, the paper conveyance speed with respect to the intermediate transfer belt changes, the intermediate transfer belt is pulled by the paper sheet, and the speed of the intermediate transfer belt changes. The enlargement rate of the image to be printed then changes in the conveying direction, or color shifting then occurs due to a change in the transfer position of the image, resulting in lower print quality. Particularly, color shifting becomes larger as time passes after the start of the printing. Therefore, the degradation in quality becomes visible to users, and the commercial value of the printed material is seriously damaged.

The above problem can be solved by driving the heating conveyance roller at a speed in accordance with the outer diameter of the heating conveyance roller. The outer diameter of the heating conveyance roller depends on the temperature of the heating conveyance roller, and therefore, it is necessary to use a contact-type temperature sensor having higher measurement precision than a noncontact type.

As a technique using a contact-type temperature sensor, there is a disclosed temperature control technique by which a temperature sensor is provided at the center portion of a heating conveyance roller, the temperature of a portion at which a paper sheet exists is measured, and the temperature of the end portions of the heating conveyance roller is estimated based on information about the measured temperature, paper existence/nonexistence information, and size information (see JP 8-286551 A, for example).

There is also a disclosed technique by which temperature sensors are provided at the center portion and an end portion of the fixing belt in the width direction, temperatures are measured, the temperature of the heating conveyance roller is predicted based on analytical information about the temperature distribution, and the rotation drive speed is corrected based on the predicted temperature (see JP 2009-276580 A, for example).

However, a contact-type temperature sensor is in contact with the heating conveyance roller and damages the surface of the roller. Therefore, if such a contact-type temperature sensor is provided within the paper conveyance width as disclosed in JP 8-286551 A, the image formed on the back surface might be adversely affected.

By the technique disclosed in JP 2009-276580 A, contact-type temperature sensors are attached not to the heating conveyance roller but to the fixing belt. Therefore, the temperatures of the portions of the heating conveyance roller through which a paper sheet is actually conveyed cannot be accurately measured, and the paper sheet cannot be conveyed at a stable speed.

SUMMARY OF THE INVENTION

An object of the present invention is to provide an image forming apparatus that can convey a paper sheet at a stable speed and reduce adverse influence on images, and a conveyance speed control method.

To achieve the abovementioned object, according to an aspect, an image forming apparatus reflecting one aspect of the present invention comprises: an intermediate transfer belt to which a toner image is transferred in a primary transfer process; a transfer roller that transfers the toner image onto a long paper sheet in a secondary transfer process by following the rotation of the intermediate transfer belt when pressed by the intermediate transfer belt; a fixing device that fixes the toner image transferred in the secondary transfer process by the transfer roller, onto the paper sheet; a temperature estimating unit; and a speed control unit, wherein the fixing device includes: a heating conveyance roller provided on the lower surface side of the paper sheet; and a fixing roller provided on the upper surface side of the paper sheet, the fixing roller facing the heating conveyance roller, when the paper sheet is made to pass through a nip portion formed by heating and pressing the heating conveyance roller and the fixing roller against each other, the paper sheet is heated and pressed, the toner image is fixed onto the paper sheet, and the paper sheet is conveyed toward the downstream side in the conveying direction, a contact-type temperature sensor is provided outside the paper conveyance width of the heating conveyance roller, the temperature estimating unit estimates a temperature of a contact portion of the heating conveyance roller in contact with the paper sheet based on temperature information obtained by the temperature sensor and paper width information about the paper sheet, and the speed control unit controls a rotation speed of the heating conveyance roller based on the temperature estimated by the temperature estimating unit.

According to an invention of Item. 2, in the image forming apparatus of Item. 1, the speed control unit preferably estimates the outer diameter of the heating conveyance roller based on the temperature estimated by the temperature estimating unit, and controls the rotation speed of the heating conveyance roller based on the estimated outer diameter.

According to an invention of Item. 3, in the image forming apparatus of Item. 1 or 2, the temperature estimating unit preferably estimates the temperature of a contact portion of the heating conveyance roller in contact with an edge of the paper sheet.

According to an invention of Item. 4, in the image forming apparatus of any one of Items. 1 to 3, the heating conveyance roller is preferably formed in a crown shape with the contact portion having an outer diameter varying with paper widths, and the speed control unit preferably further controls the rotation speed of the heating conveyance roller based on the position of the contact portion in the axial direction.

According to an invention of Item. 5, in the image forming apparatus of any one of Items. 1 to 4, the speed control unit preferably further controls the rotation speed of the heating conveyance roller based on paper thickness information about the paper sheet.

According to an invention of Item. 6, in the image forming apparatus of Item. 5, the speed control unit preferably acquires the paper thickness information by referring to a paper thickness table in which paper types and basis weights are associated with paper thicknesses.

According to an invention of Item. 7, in the image forming apparatus of any one of Items. 1 to 6, during image formation, the temperature estimating unit preferably estimates the temperature of the contact portion based on the temperature information at the start of the image formation and the temperature information at the present time, when jobs are successively performed in the image formation, and the time between the previous job and the current job is equal to or shorter than a predetermined time, the temperature estimating unit preferably estimates the temperature of the contact portion at the start of the image formation based on the temperature information at the start of the image formation in the previous job and the temperature information at the start of the image formation in the current job, and during the image formation in the current job, the temperature estimating unit preferably estimates the temperature of the contact portion during the image formation in the current job based on the temperature of the contact portion at the start of the image formation in the current job and the temperature information at the present time.

According to an invention of Item. 8, in the image forming apparatus of any one of Items. 1 to 7, the rotation speed of the heating conveyance roller is preferably higher than the speed of the intermediate transfer belt.

According to an invention of Item. 9, a conveyance speed control method using the image forming apparatus of any one of Items. 1 to 8 preferably includes: estimating the temperature of the contact portion of the heating conveyance roller in contact with the paper sheet based on the temperature information obtained by the temperature sensor and the paper width information about the paper sheet; and controlling the rotation speed of the heating conveyance roller based on the estimated temperature, wherein, during image formation, the temperature of the contact portion is estimated based on the temperature information at the start of the image formation and the temperature information at the present time.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIG. 7 is a diagram showing an example of a paper thickness table;

DESCRIPTION OF THE PREFERRED EMBODIMENTS

Hereinafter, an embodiment of the present invention will be described in detail with reference to the drawings. However, the scope of the invention is not limited to the illustrated examples.

Figure 1:
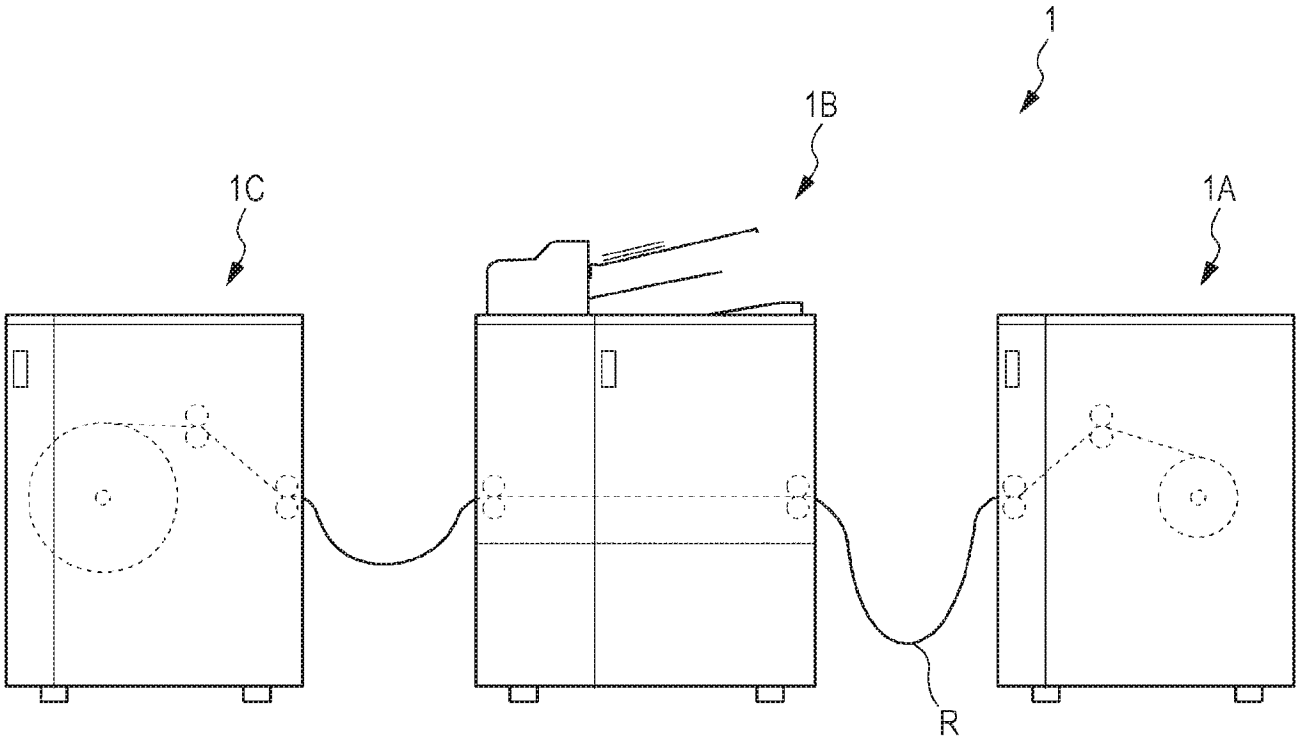
FIG. 1 is a diagram schematically showing the structure of an image forming apparatus according to an embodiment.

An image forming apparatus 1 according to this embodiment includes a sheet feeder 1A, an image forming apparatus main unit 1B, and a winder 1C, as shown in FIG. 1.

The sheet feeder 1A stores a long paper sheet such as roll paper or continuous paper (roll paper R in this embodiment), and supplies the long paper sheet in accordance with an instruction from the image forming apparatus main unit 1B. In this embodiment, a long paper sheet is a paper sheet that has at least such a length as to be simultaneously nipped between a secondary transfer roller 46 (see FIG. 2) and an opposed secondary transfer roller 461 (see FIG. 2), and between a heating conveyance roller F1 (see FIG. 2) and a fixing roller F2 (see FIG. 2). The long paper sheet supplied from the sheet feeder 1A to the image forming apparatus main unit 1B is conveyed to an image forming unit 40 (see FIGS. 2 and 3) through a predetermined conveyance path.

The image forming apparatus main unit 1B forms an image on the long paper sheet supplied from the sheet feeder 1A.

The winder 1C winds up the ejected long paper sheet having the image formed thereon by the image forming apparatus main unit 1B.

Figure 2:
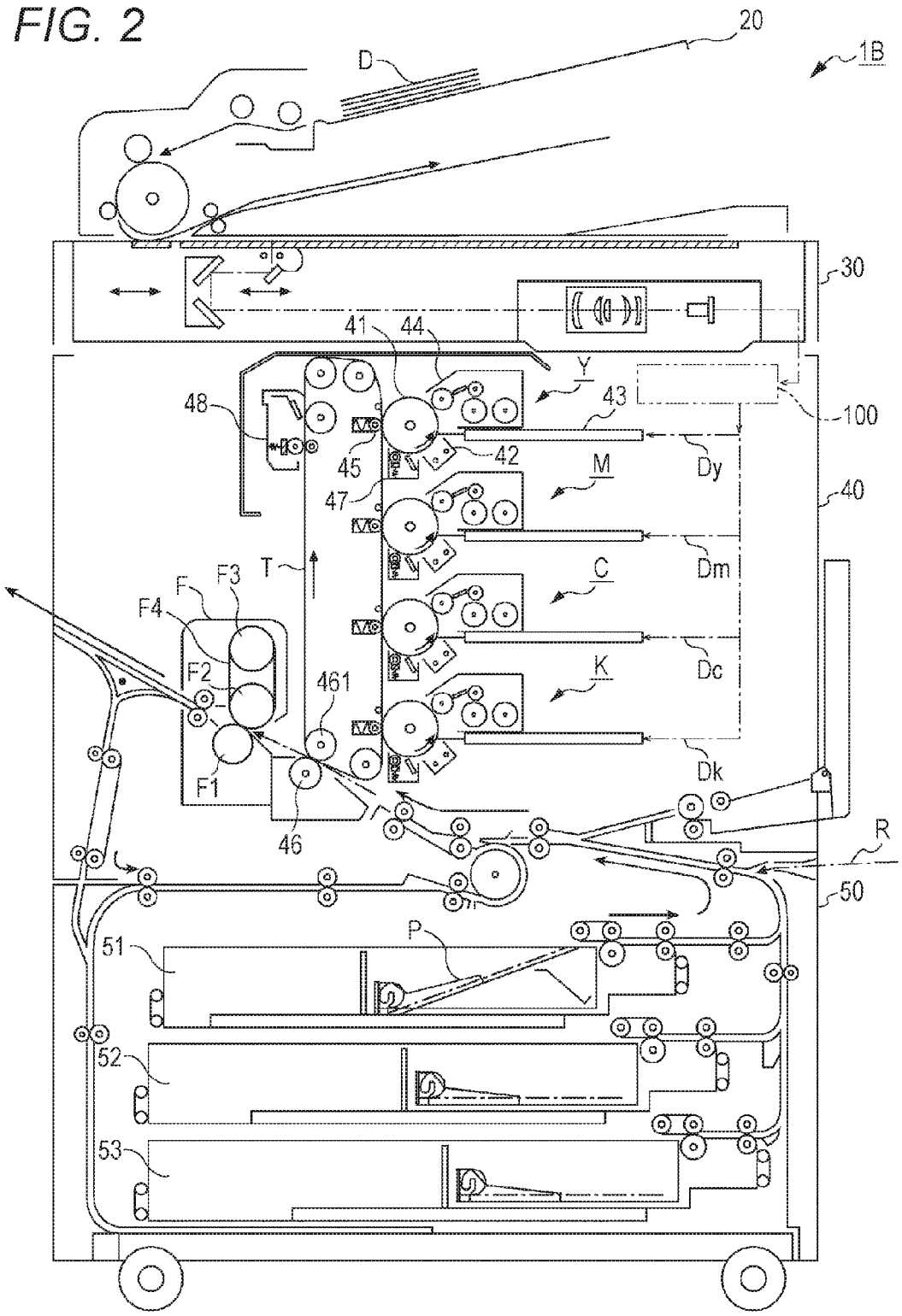
FIG. 2 is a diagram schematically showing the structure of the image forming apparatus main unit according to the embodiment.
Figure 3:
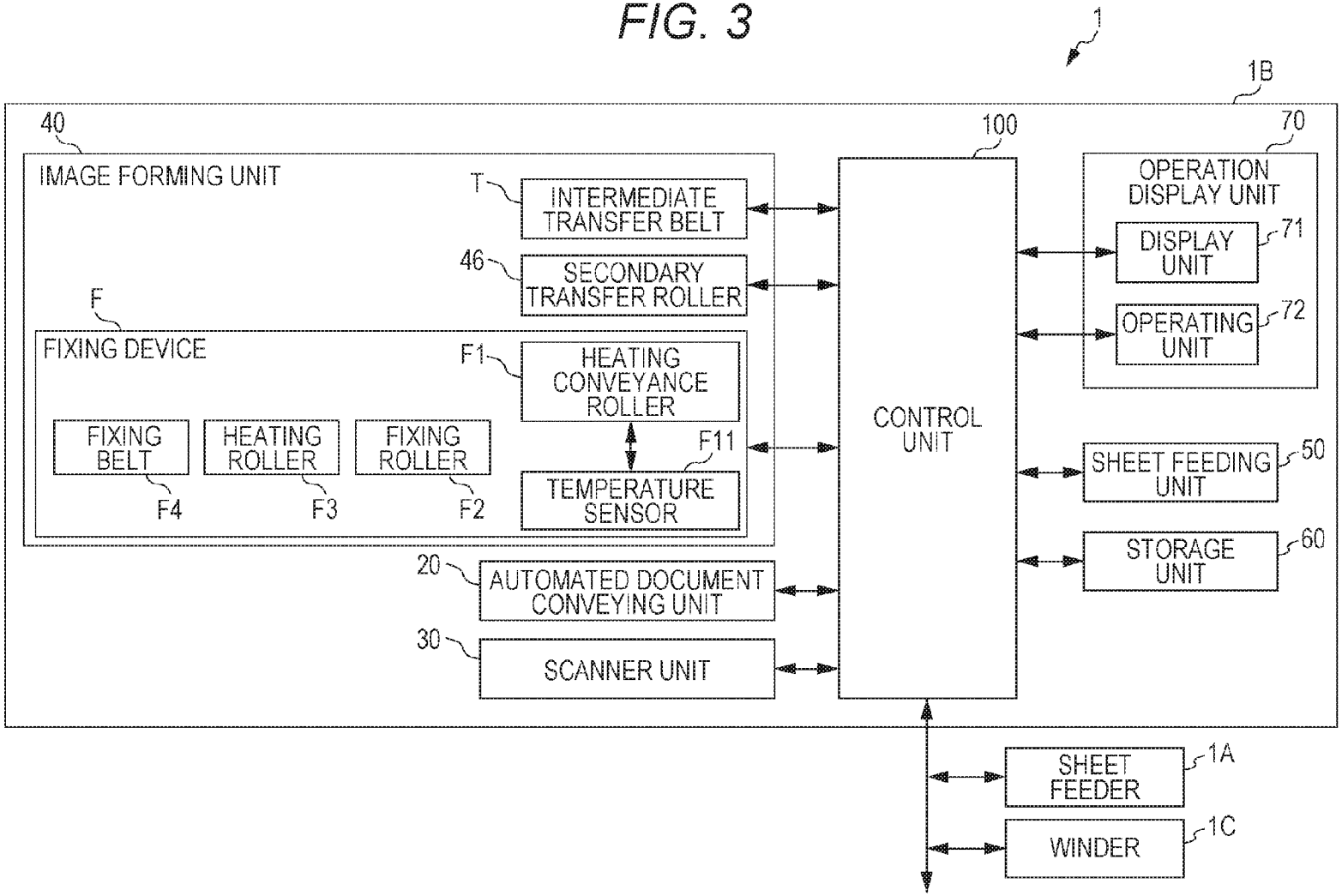
FIG. 3 is a functional block diagram showing the control structure in the image forming apparatus according to the embodiment.

The image forming apparatus main unit 1B is a color image forming apparatus of an intermediate transfer type that utilizes an electrophotographic process. As shown in FIGS. 2 and 3, the image forming apparatus main unit 1B includes an automated document conveying unit 20, a scanner unit 30, an image forming unit 40, a sheet feeding unit 50, a storage unit 60, an operation display unit 70, and a control unit 100.

The automated document conveying unit 20 includes a paper tray on which a document D is placed, and a mechanism and a conveyance roller for conveying the document D. The automated document conveying unit 20 conveys the document D to a predetermined conveyance path.

The scanner unit 30 includes a light source and an optical system such as a reflecting mirror. The scanner unit 30 irradiates the document D conveyed to the predetermined conveyance path or the document D placed on the platen glass with light from the light source, and then receives the reflected light. The scanner unit 30 also converts the received reflected light into an electrical signal, and outputs the electrical signal to the control unit 100.

The image forming unit 40 includes a yellow image forming unit Y, a magenta image forming unit M, a cyan image forming unit C, a black image forming unit K, an intermediate transfer belt T, and a fixing device F.

The respective image forming units Y, M, C, and K form toner images in yellow, magenta, cyan, and black, respectively, on photosensitive drums 41, and the Y, M, C, and K toner images formed on the photosensitive drums 41 are transferred to the intermediate transfer belt T in a primary transfer process.

The structures and operations of the respective image forming units Y, M, C, and K are the same. In the description below, an example image forming operation to be performed by the image forming unit 40 will be described with respect to the yellow image forming unit Y.

The surface of the photosensitive drum 41 is formed with a photosensitive layer that includes an organic semiconductor layer having a phthalocyanine pigment scattered in polycarbonate, and a charge transport layer.

A charging device 42 uniformly charges the photosensitive drum 41.

An exposure device 43 exposes the non-image area on the photosensitive drum 41 based on image data Dy supplied from the control unit 100, removes the electrical charge from the exposed portion, and forms an electrostatic latent image in the image area on the photosensitive drum 41.

A developing device 44 supplies toner as a developing agent onto the electrostatic latent image formed on the photosensitive drum 41, to form a yellow toner image on the photosensitive drum 41.

A primary transfer roller 45 transfers the yellow toner image formed on the photosensitive drum 41 to the intermediate transfer belt T in a primary transfer process.

As for the other image forming units M, C, and K, magenta, cyan, and black toner images are also transferred to the intermediate transfer belt T in the primary transfer process. As a result, the toner images in the respective colors Y, M, C, and K are formed on the intermediate transfer belt T.

The intermediate transfer belt T is a semiconductive endless belt that is suspended and rotatably supported by rollers. The intermediate transfer belt T is rotatively driven when the rollers rotate.

This intermediate transfer belt T is pressed against the respective photosensitive drums 41 by the primary transfer rollers 45. A transfer current corresponding to the applied voltage is applied to each of the primary transfer rollers 45. With this, the toner images developed on the respective photosensitive drums 41 are sequentially transferred to the intermediate transfer belt T by the primary transfer rollers 45 in the primary transfer process.

The secondary transfer roller (the transfer roller) 46 is pressed against the intermediate transfer belt T and rotates following the intermediate transfer belt T. While doing so, the secondary transfer roller 46 transfers the Y, M, C, and K toner images transferred to and formed on the intermediate transfer belt T, onto a paper sheet P conveyed from one of the paper feed trays 51 to 53 of the sheet feeding unit 50 or onto the roll paper (the paper sheet) R supplied from the sheet feeder 1A in a secondary transfer process. The secondary transfer roller 46 is located in contact with the opposed secondary transfer roller 461 via the intermediate transfer belt T. As a paper sheet (the paper sheet P or the roll paper R) passes through a transfer nip formed between the secondary transfer roller 46 and the opposed secondary transfer roller 461, the toner images on the intermediate transfer belt T are transferred onto the paper sheet in the secondary transfer process.

Figure 4A:
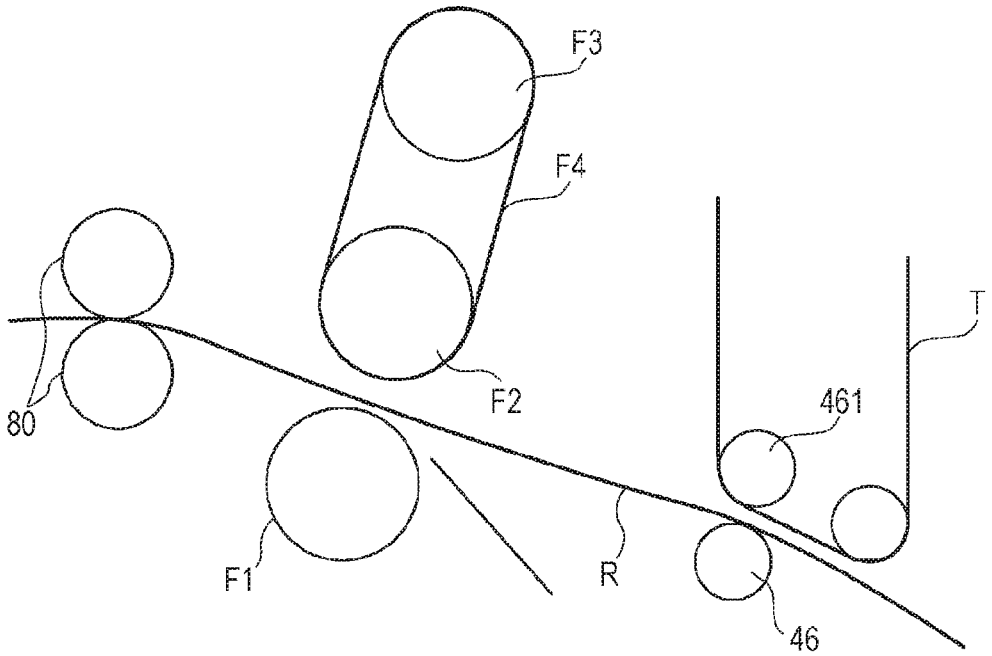
FIGS. 4A and 4B are diagrams showing examples of a separated state and a pressed state.
Figure 4B:
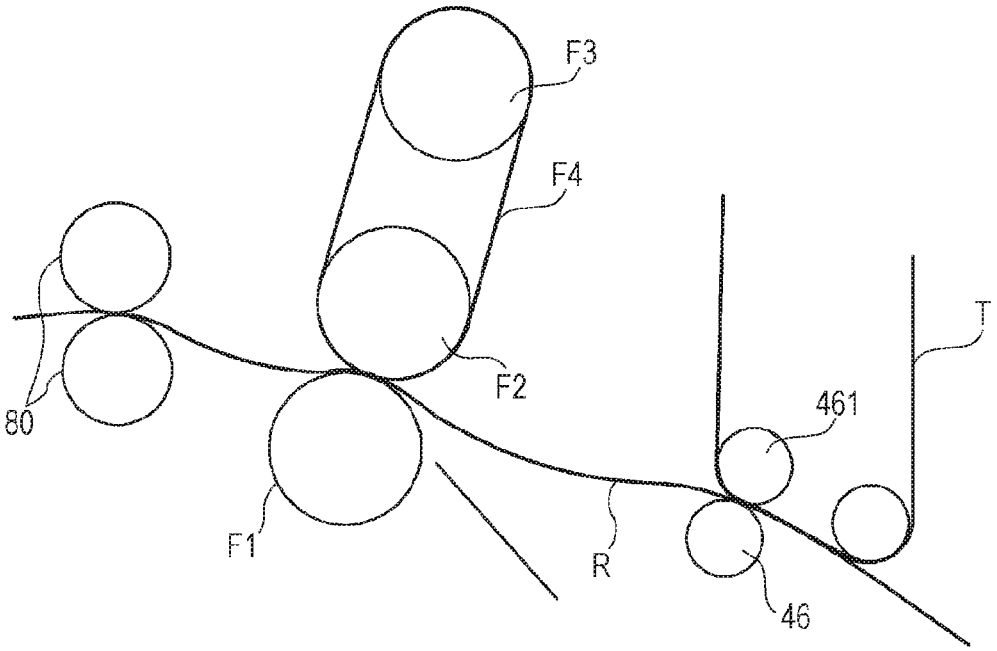

As shown in FIGS. 4A and 4B, the secondary transfer roller 46 can be pressed against or be separated from the opposed secondary transfer roller 461. In an idling state, the secondary transfer roller 46 is separated from the opposed secondary transfer roller 461.

The fixing device F includes the heating conveyance roller F1 located on the lower surface side of the paper sheet, the fixing roller F2 and a heating roller F3 located on the upper surface side, and a fixing belt F4. The fixing device F heats and presses the heating conveyance roller F1 and the fixing roller F2 against each other, to form a nip portion. As the paper sheet passes through the nip portion, the fixing device F heats and presses the paper sheet, so that the transferred toner image is fixed to the paper sheet, and the paper sheet is conveyed toward the downstream side in the conveying direction.

The heating conveyance roller F1 is made of rubber and has a cylindrical shape. Like the heating roller F3, the heating conveyance roller F1 has a high-power heater therein. The heating conveyance roller F1 rotates in the forward conveying direction of the paper sheet, and heats and presses the unfixed surface of the conveyed paper sheet. As shown in FIGS. 4A and 4B, the heating conveyance roller F1 can be pressed against or be separated from the fixing roller F2. In an idling state, the heating conveyance roller F1 is separated from the fixing roller F2.

The fixing roller F2 is made of sponge-like foam rubber having a lower degree of hardness than the heating conveyance roller F1, and has a cylindrical shape. The fixing roller F2 rotates in the forward conveying direction of the paper sheet, and heats and presses the fixed surface of the conveyed paper sheet via the fixing belt F4.

The heating roller F3 has a high-power heater therein, rotates in the forward conveying direction of the paper sheet, and heats the fixing roller F2 via the fixing belt F4.

The fixing belt F4 is wider than the paper width, and is stretched by the fixing roller F2 and the heating roller F3. The fixing belt F4 rotates following the paper sheet being conveyed by the heating conveyance roller F1. Accordingly, the paper conveyance speed is determined by the outer diameter of the heating conveyance roller F1.

Figure 5:
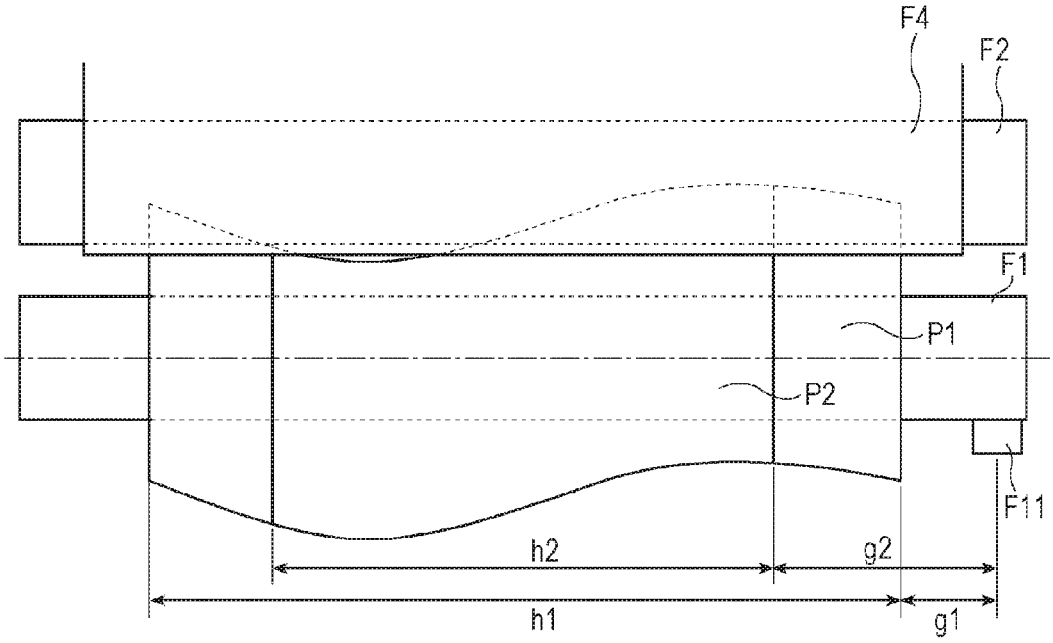
FIG. 5 is a diagram schematically showing the structure of a fixing device.

A contact-type temperature sensor F11 is further provided at an end portion in the axial direction of the heating conveyance roller F1 or outside the paper conveyance width (see FIG. 5). While the heating conveyance roller F1 is pressed against the fixing roller F2 (the fixing belt F4), the temperature sensor F11 is located outside the fixing belt F4 in terms of the axial direction.

Since the center of the paper sheet passes through the center of the heating conveyance roller F1 in this embodiment, the distance between the temperature sensor F11 and the edge of the paper sheet on the side of the temperature sensor F11 varies with the paper width. For example, as shown in FIG. 5, a distance g1 from the temperature sensor F11 is shorter in the case of a paper sheet P1 having a great paper width h1, and a distance g2 from the temperature sensor F11 is longer in the case of a paper sheet P2 having a smaller paper width h2.

The heater provided in the heating conveyance roller F1 can heat the three kinds of portions thereof independently of one another: the center portion, the portions outside the center portion, and the end portions. The heating range is controlled in accordance with the paper width. The temperature of the heating conveyance roller F1 is controlled by the heater, so as to maintain a predetermined temperature.

In this embodiment, for each of the paper widths of paper sheets being conveyed, the temperature of the contact portion between the paper sheet during printing (image formation) and the heating conveyance roller F1 is measured, and the relationship between the temperature information obtained from the temperature sensor F11 and the temperature of the contact portion is analyzed to determine the correction coefficient for adjusting the temperature information obtained from the temperature sensor F11 to the temperature of the contact portion.

Figure 6A:
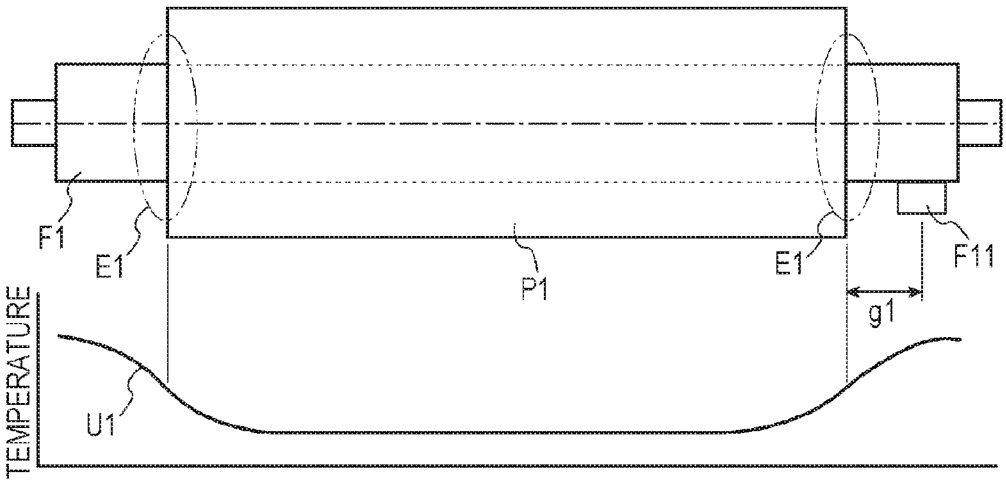
FIGS. 6A and 6B are diagrams showing axial-direction temperature distributions in a heating conveyance roller.
Figure 6B:
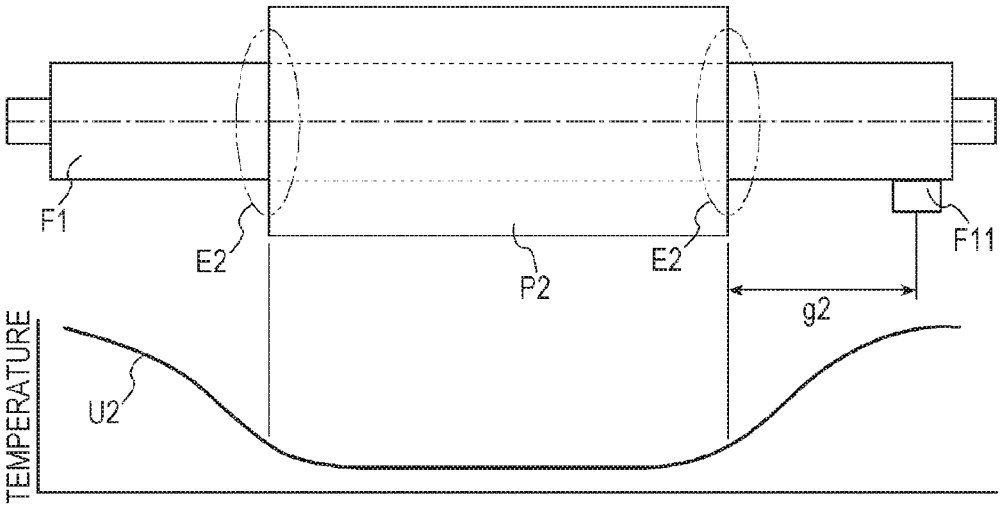

Here, as shown in FIGS. 6A and 6B, among the portions of the heating conveyance roller F1 in contact with a paper sheet, the portions (E1 and E2 in the drawings) near the edge portions of the paper sheet have the highest temperature (see temperature distributions U1 and U2), regardless of the paper width. Therefore, the outer diameter at these portions becomes the largest, and determines the paper conveyance speed. Various paper widths can be selected in accordance with purposes of use, and the temperature to be sensed by the temperature sensor F11 provided outside the paper widths varies with the paper widths. Therefore, for each of the paper widths of paper sheets being conveyed, the temperature of the contact portion between an edge portion of the paper sheet during printing and the heating conveyance roller F1 may be measured, and the relationship between the temperature information obtained from the temperature sensor F11 and the temperature of the contact portion may be analyzed to determine the correction coefficient for adjusting the temperature information obtained from the temperature sensor F11 to the temperature of the contact portion, for example.

With the correction coefficient that is set for each paper width, the contact portion temperature to be used in calculating thermal expansion of the heating conveyance roller F1 is estimated.

That is, the fixing device F of the image forming unit 40 heats and presses the paper sheet having the Y, M, C, and K toner images transferred thereonto in a secondary transfer process, and the image forming unit 40 then ejects the paper sheet out of the apparatus through a predetermined conveyance path (such as an ejecting roller 80).

The above described operation is an image forming operation to be performed by the image forming unit 40.

Here, the speeds of the respective conveyance rollers are set as follows: "the ejecting roller 80>the heating conveyance roller F1>the intermediate transfer belt T>the upstream conveyance roller (not shown)". With this, tension is constantly applied to the roll paper R while the roll paper R is being conveyed. At a time of printing, the upstream conveyance roller (not shown) is not driven but rotates following the roll paper R.

Cleaning devices 47 remove residues such as residual toner and paper dust remaining on the surfaces of the photosensitive drums 41 after primary transfer. A cleaning device 48 removes residues on the intermediate transfer belt T after secondary transfer.

The cleaning devices 47 and the cleaning device 48 are the same in removing residues on the photosensitive drums 41 or the intermediate transfer belt T, having the same structures and operating in the same manner.

The sheet feeding unit 50 includes the paper feed trays 51 to 53, and stores paper sheets P of different types in the paper feed trays 51 to 53. The sheet feeding unit 50 supplies the stored paper sheets P to the image forming unit 40 through a predetermined conveyance path.

The storage unit 60 is formed with an HDD (Hard Disk Drive) or a semiconductor memory, for example, and stores data such as program data and various setting data in such a manner that the control unit 100 can read the data. The storage unit 60 also stores a paper thickness table in which paper types are associated with paper thicknesses with respect to respective basis weights (see FIG. 7).

The operation display unit 70 is formed with a liquid crystal display (LCD) having a touch panel, for example, and functions as a display unit 71 and an operation unit 72.

The display unit 71 displays various operation screens, operating conditions of respective functions, and the like, in accordance with display control signals that are input from the control unit 100. The display unit 71 also receives a touch operation performed by a user, and outputs an operating signal to the control unit 100.

The operation unit 72 includes various kinds of operation keys such as a numeric keypad and a start key, to receive various input operations from users and output operating signals to the control unit 100. By operating the operation display unit 70, a user can designate settings in image formation such as an image quality setting, an enlargement rate setting, an application setting, an output setting, and a paper sheet setting, and can also issue a paper conveyance instruction, an apparatus stop instruction, and the like.

The control unit 100 includes a CPU, a RAM, a ROM, and the. The CPU loads various programs stored in the ROM into the RAM, and, in conjunction with the loaded various programs, collectively controls operations of the respective components of the image forming apparatus main unit 1B such as the automated document conveying unit 20, the scanner unit 30, the image forming unit 40, the sheet feeding unit 50, the storage unit 60, and the operation display unit 70, the sheet feeder 1A, and the winder 1C (see FIG. 3). For example, the control unit 100 receives an electrical signal input from the scanner unit 30, performs various kinds of image processing, and outputs image data Dy, Dm, Dc, and Dk of the respective colors Y, M, C, and K generated through the image processing to the image forming unit 40. The control unit 100 also controls operation of the image forming unit 40, to form an image on a paper sheet.

Figure 8:
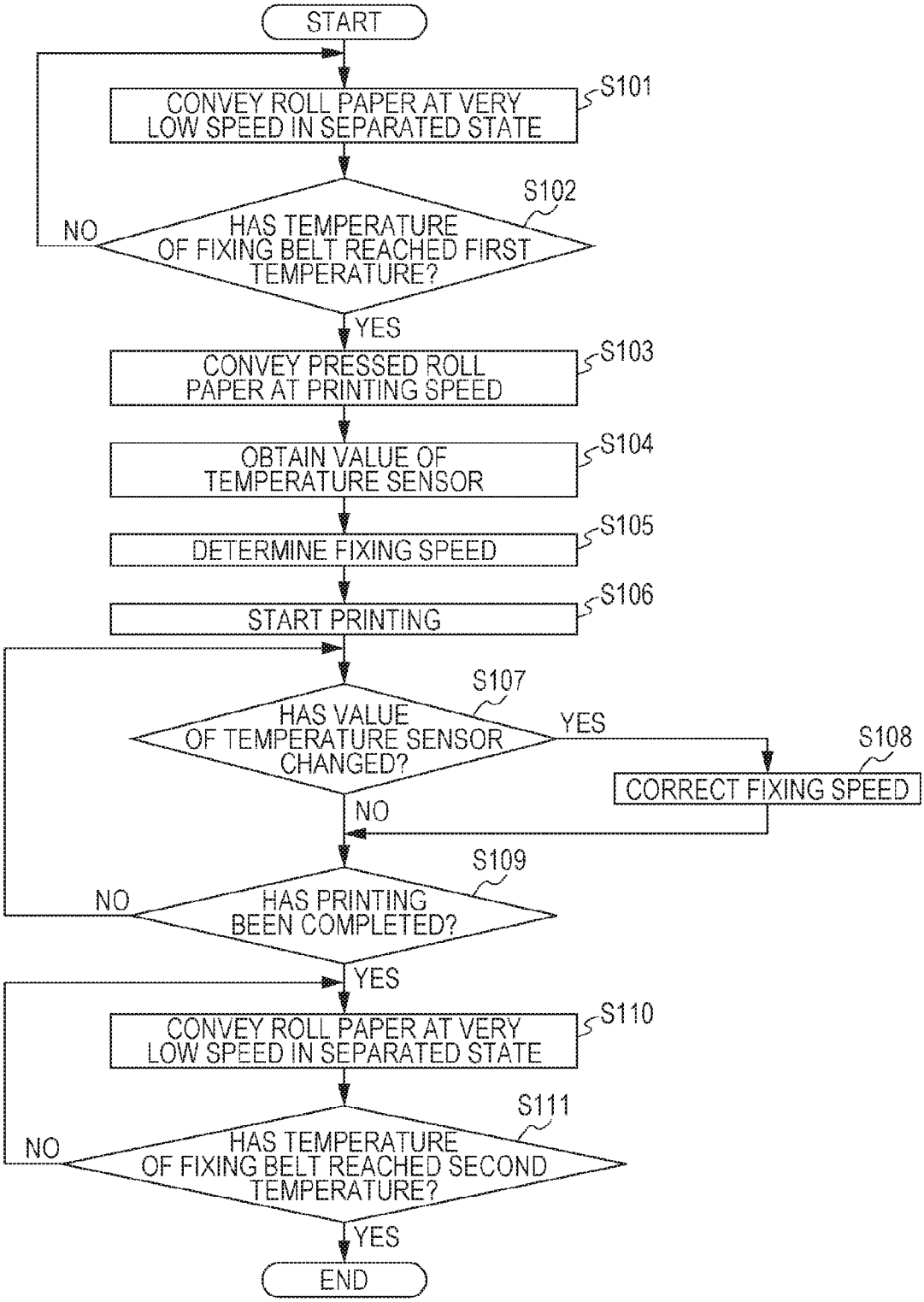
FIG. 8 is a flowchart showing an operation of the image forming apparatus according to the embodiment.

Referring now to the flowchart in FIG. 8, the operation of the image forming apparatus 1 according to this embodiment is described. In this embodiment, an image is to be formed on the roll paper R supplied from the sheet feeder 1A, for example.

First, the control unit 100 conveys the roll paper R at a very low speed in a situation where the secondary transfer roller 46 and the heating conveyance roller F1 are separated from each other (see FIG. 4A) (step S101). Specifically, when the fixing belt F4 and the heating conveyance roller F1 are heated to a predetermined temperature at a start of printing, the control unit 100 controls the conveyance rollers and the like (not shown) provided on the upstream side of the ejecting roller 80 and the secondary transfer roller 46, to convey the roll paper R at a very low speed along the rollers provided on the lower side of the conveyance path, while the secondary transfer roller 46 and the heating conveyance roller F1 are separated from each other. With this, the heat from the fixing belt F4 and the heating conveyance roller F1 does not continue to be applied to a certain portion of the roll paper R, and paper burning can be restrained.

The control unit 100 then determines whether the temperature of the fixing belt F4 has reached a first temperature (step S102). Here, the first temperature is the necessary temperature for a start of printing.

If the temperature is determined to have reached the first temperature (YES in step S102), the operation moves on to step S103.

If the temperature is determined not to have reached the first temperature (NO in step S102), the operation returns to step S101, and the very slow conveyance of the roll paper R is continued until the temperature reaches the first temperature.

The control unit 100 then presses the secondary transfer roller 46 and the heating conveyance roller F1 against the opposed secondary transfer roller 461 and the fixing roller F2, respectively (see FIG. 4B), and conveys the roll paper R at the printing speed (step S103).

The control unit 100 then obtains the value of the temperature sensor F11 (step S104). Thereafter, the value of the temperature sensor F11 is obtained at predetermined regular intervals. The predetermined regular intervals are not particularly limited, and the value of the temperature sensor F11 may be obtained at intervals of 10 seconds, or may be obtained every second, for example. The value of the temperature sensor F11 obtained in step S104 is stored into the storage unit 60.

The control unit 100 then determines the fixing speed that is the rotation speed of the heating conveyance roller F1 at the time of fixing of an image onto the paper sheet on which the image is formed (step S105). Since the roll paper R separated from the heating conveyance roller F1 was conveyed at a very low speed at the start of printing, the temperature of the heating conveyance roller F1 is almost uniform in the axial direction at the time of step S105, which is only a short time after the pressing of the secondary transfer roller 46 and the heating conveyance roller F1. Therefore, the control unit 100 determines the fixing speed based on the value (temperature information) of the temperature sensor F11 obtained in step S104.

Where V0 represents the reference speed that is the initial value of the fixing speed, Dn represents the roller diameter (specification value) of the heating conveyance roller F1, Ds indicates the roller diameter at the start of printing, and Q represents the paper thickness, the fixing speed V1 at the start of printing can be calculated according to the mathematical formula (1) shown below. The control unit 100 obtains the paper thickness Q (paper thickness information) by referring to the paper thickness table stored in the storage unit 60.

$$V1=V0\times(Dn/(Ds+Q))$$ Mathematical formula (1):

wherein T1 represents the current temperature (the printing start temperature) that is the value of the temperature sensor F11 obtained in step S104, T0 represents the temperature (normal temperature) at the time of measurement of the roller diameter, and L represents the thermal expansion coefficient of the roller diameter, the roller diameter Ds at the start of printing can be calculated according to the mathematical formula (2).

$$Ds=Dn+(T1-T0)\times L$$ Mathematical formula (2):

In this embodiment, correction is to be performed under the following conditions: the reference speed V0 is 315.8 mm/s (the speed of the intermediate transfer belt T is 315 mm/s), the roller diameter (specification value) Dn is ϕ60 mm, the roller diameter measurement temperature (normal temperature) T0 is 24° C., and the thermal expansion coefficient L is 0.0049 mm/° C.

In this case, the fixing speed V1 at the start of printing is 315.8×(ϕ60/(ϕ60+(T1−24)×0.0049+Q)) [mm/s].

The control unit 100 then starts the print job (step S106).

The control unit 100 then determines whether the obtained value of the temperature sensor F11 has changed from the value of the temperature sensor F11 obtained last time (step S107).

If the value of the temperature sensor F11 is determined to have changed (YES in step S107), the operation moves on to step S108.

If the value of the temperature sensor F11 is determined not to have changed (NO in step S107), the operation moves on to step S109.

The control unit 100 then corrects the fixing speed (step S108). During the printing, the roll paper R is conveyed with the heating conveyance roller F1 pressed against the fixing roller F2. Therefore, the heat of the contact portion of the heating conveyance roller F1 in contact with the roll paper R is absorbed by the paper sheet, and the temperature of the contact portion becomes lower. Meanwhile, the portions (end portions) of the heating conveyance roller F1 not in contact with the roll paper R is heated by the opposed fixing belt F4, and the temperature of these portions becomes higher (see FIG. 6 and others). That is, the temperature of the end portions of the heating conveyance roller F1 to which the temperature sensor F11 is attached differs from the temperature at the start of the printing when the temperature was almost uniform in the axial direction. Therefore, the control unit 100 corrects the fixing speed based on the difference between the latest value of the temperature sensor F11 and the value of the temperature sensor F11 (the printing start temperature T1) obtained in step S104.

Where Dp represents the roller diameter during the printing, the fixing speed V2 during the printing can be calculated according to the mathematical formula (3).

$$V2=V0\times(Dn/(Dp+Q))$$ Mathematical formula (3):

wherein T2 represents the current temperature (the current temperature during printing) that is the latest value of the temperature sensor F11, and W represents the correction coefficient, the roller diameter Dp during the printing can be calculated according to the mathematical formula (4).

$$Dp=Ds+(T2-T1)\times W\times L$$ Mathematical formula (4):

That is, the control unit 100 functions as a temperature estimating unit that estimates the temperature of the contact portion of the heating conveyance roller F1 in contact with the paper sheet based on the temperature information obtained from the temperature sensor F11 and the paper width of the paper sheet (the paper width information). As the temperature estimating unit, the control unit 100 also estimates the temperature (T1×W) of the contact portion at the start of printing from the temperature information at the start of printing (the printing start temperature T1), and estimates the current temperature (T2×W) of the contact portion from the current temperature information (the current temperature T2 during printing).

The control unit 100 then functions as a speed control unit that controls the rotation speed (the fixing speed) of the heating conveyance roller F1 based on the temperatures ("T1×W" and "T2×W") estimated by the temperature estimating unit. As the speed control unit, the control unit 100 further controls the rotation speed of the heating conveyance roller F1 based on the paper thickness information about the paper sheet. More specifically, the control unit 100 first calculates the roller diameter Dp during the printing (see the mathematical formula (4)) based on the temperatures estimated by the temperature estimating unit, and calculates the fixing speed V2 during the printing (see the mathematical formula (3)) based on the calculated roller diameter Dp during the printing.

In this embodiment, correction is to be performed under the following conditions: the paper width of the roll paper R is 330 mm, and the correction coefficient W for the paper width of 330 mm is ⅓.

In this case, the fixing speed V2 during the printing is $315.8\times(\phi 60/(\phi 60+((T1-24)+(T2-T1)/3)\times 0.0049+Q))$ [mm/s].

The control unit 100 then determines whether the print job has been completed (step S109).

If the print job is determined to have been completed (YES in step S109), the operation moves on to step S110.

If the print job is determined not to have been completed (NO in step S109), the operation returns to step S107, and a check is made to determine whether the value of the temperature sensor F11 has changed.

The control unit 100 then conveys the roll paper R at a very low speed in a situation where the secondary transfer roller 46 and the heating conveyance roller F1 are separated from each other (see FIG. 4A) (step S110). With this, the end portions of the heating conveyance roller F1 are not heated by the opposed fixing belt F4, and the temperature of the end portions becomes lower.

The control unit 100 then determines whether the temperature of the fixing belt F4 has reached a second temperature (step S111). Here, the second temperature is such a temperature as not to cause paper burning even if the conveyance of the roll paper R is stopped.

If the temperature is determined to have reached the second temperature (YES in step S111), the operation comes to an end.

If the temperature is determined not to have reached the second temperature (NO in step S111), the operation returns to step S110, and the very slow conveyance of the roll paper R is continued until the temperature reaches the second temperature.

As described above, in the image forming apparatus 1 according to this embodiment, the fixing device F includes the heating conveyance roller F1 located on the lower surface side of the paper sheet, and the fixing roller F2 that is located on the upper surface side of the paper sheet so as to face the heating conveyance roller F1. The contact-type temperature sensor F11 is provided outside the paper conveyance width of the heating conveyance roller F1. The image forming apparatus 1 includes the temperature estimating unit (the control unit 100) that estimates the temperature of the contact portion of the heating conveyance roller F1 in contact with the paper sheet based on the temperature information obtained from the temperature sensor F11 and the paper width information about the paper sheet, and the speed control unit (the control unit 100) that controls the rotation speed of the heating conveyance roller F1 based on the temperature estimated by the temperature estimating unit.

Accordingly, with the image forming apparatus 1 according to this embodiment, the temperature of the contact portion of the heating conveyance roller F1 in contact with the paper sheet can be accurately estimated. Thus, the paper sheet can be conveyed at a stable speed, and adverse influence on the image such as color shifting can be reduced. Further, as the temperature sensor F11 is provided in a position that is not in contact with paper sheet, the fixing speed can be controlled, without any damage being inflicted on the image on the back surface of the paper sheet.

Further, in the image forming apparatus 1 according to this embodiment, the speed control unit estimates the outer diameter of the heating conveyance roller F1 based on the temperature estimated by the temperature estimating unit, and controls the rotation speed of the heating conveyance roller F1 based on the estimated outer diameter. Accordingly, the speed control unit can appropriately control the fixing speed in accordance with thermal expansion of the heating conveyance roller F1, and reduce adverse influence on the image with higher accuracy.

Further, in the image forming apparatus 1 according to this embodiment, the temperature estimating unit estimates the temperature of the contact portions between the heating conveyance roller F1 and edges of the paper sheet. Accordingly, the fixing speed can be controlled based on the temperature of portions (E1 and E2 in the drawings) near the edges of the paper sheet at which the temperature becomes the highest in the contact portion with the paper sheet, and the paper conveyance speed can be controlled with higher precision.

Further, in the image forming apparatus 1 according to this embodiment, the speed control unit further controls the rotation speed of the heating conveyance roller F1 based on the paper thickness information about the paper sheet. Accordingly, the paper conveyance speed can be further stabilized in accordance with the speed increase corresponding to the paper thickness, and adverse influence on the image can be further reduced.

Further, in the image forming apparatus 1 according to this embodiment, the speed control unit obtains paper thickness information by referring to the paper thickness table in which paper thicknesses are associated with paper types and basis weights. Accordingly, environmental errors and manufacturing errors can be reduced, and the precision in the conveyance speed control can be increased.

Further, in the image forming apparatus 1 according to this embodiment, the rotation speed of the heating conveyance roller F1 is higher than the speed of the intermediate transfer belt T. Accordingly, it is possible to cope with changes in the enlargement rate and occurrences of color shifting that are caused by increases in the speed of the intermediate transfer belt T, and a sufficient commercial value of the printed material can be secured.

As described above, to solve the problem that the outer diameter of the heating conveyance roller F1 expands due to heating and the fixing speed becomes higher during a printing process, the roller diameter Dp during the printing is calculated based on the printing start temperature (T1×W) of the contact portion estimated from the temperature information about the heating conveyance roller F1 and the current temperature (T2×W) of the contact portion (see the mathematical formula (4)), and the fixing speed V2 during the printing is then controlled (see the mathematical formula (3)) in this embodiment.

In this manner, the fixing speed V2 can be appropriately controlled in accordance with thermal expansion of the heating conveyance roller F1. Thus, the problem of increase in the fixing speed can be solved.

Although an embodiment of the present invention has been described in detail, the present invention is not limited to the above described embodiment, and changes may be made to the embodiment without departing from the scope of the invention.

(First Modification)

Figure 9:
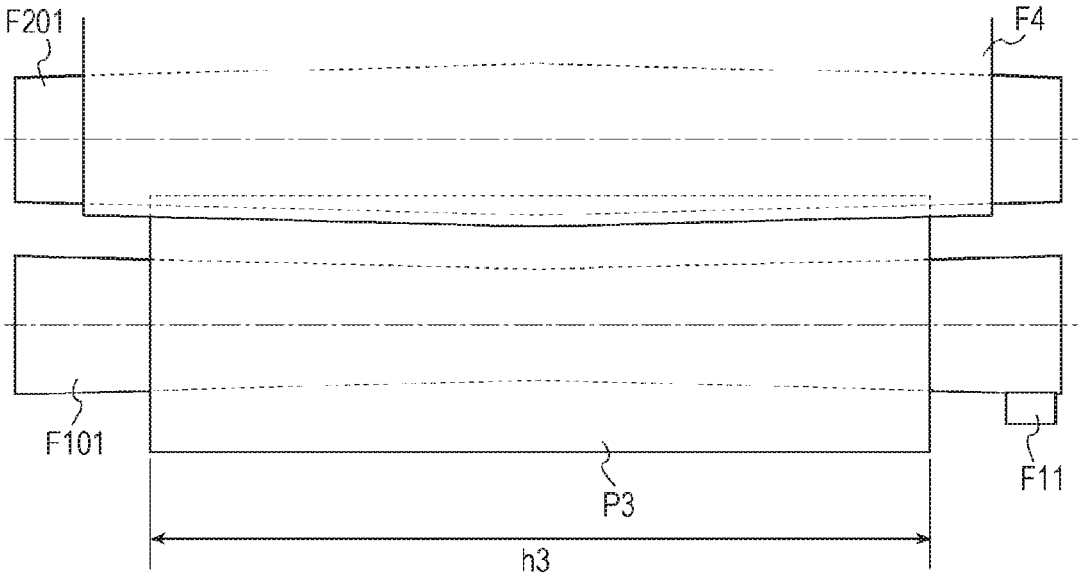
FIG. 9 is a diagram schematically showing the structure of a fixing device according to a first modification.
Figure 10:
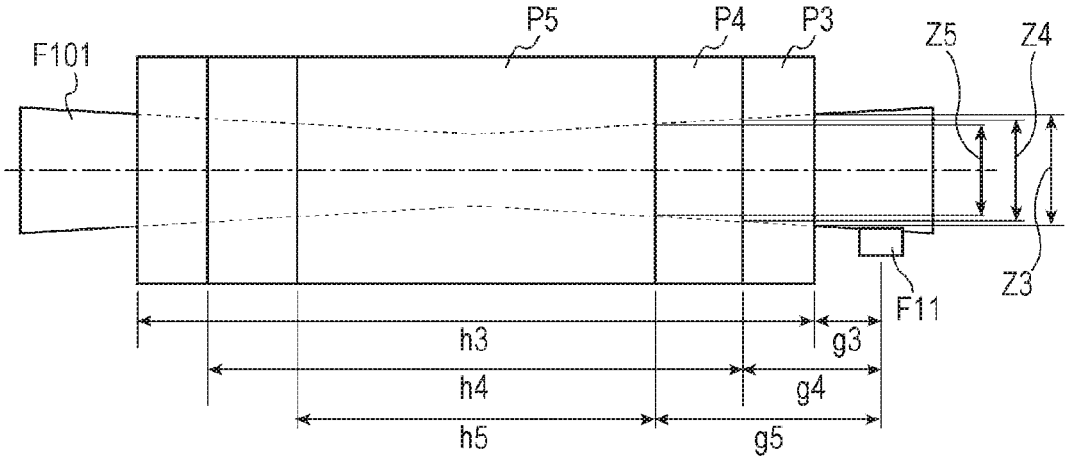
FIG. 10 is a diagram showing the relationship between paper widths and the outer diameter of a heating conveyance roller.

As shown in FIGS. 9 and 10, an image forming apparatus 1 according to a first modification differs from the image forming apparatus 1 of the above embodiment in the shapes of a heating conveyance roller F101 and a fixing roller F201. For simplicity, the same components as those in the above embodiment are denoted by the same reference numerals as those used in the above embodiment, and detailed explanation thereof is not repeated herein.

As shown in FIG. 9, the fixing roller F201 is formed in a crown shape that has a larger outer diameter at either end portion than at the center portion in the axial direction. With this shape, loosening of the fixing belt F4 is prevented.

The heating conveyance roller F101 is formed in a reverse crown shape, to form a pair with the fixing roller F201. Accordingly, as the paper width of the paper sheet being conveyed becomes smaller, the outer diameter of the contact portion of the heating conveyance roller F101 with the paper sheet becomes smaller, as shown in FIG. 10. For example, in the case of a paper sheet P3 of the greatest paper width h3, the outer diameter Z3 is ϕ60 mm, which is the largest, as shown in FIG. 10. In the case of a paper sheet P4 of the second greatest paper width h4, the outer diameter Z4 is ϕ59.98 mm, which is the second largest, as shown in FIG. 10. In the case of a paper sheet P5 of the smallest paper width h5, the outer diameter Z5 is ϕ59.96 mm, which is the smallest, as shown in FIG. 10.

Since the center of the paper sheet passes through the center of the heating conveyance roller F101 in the first modification, the distance between the temperature sensor F11 and the edge of the paper sheet on the side of the temperature sensor F11 varies with the paper width. For example, in the case of the paper sheet P3 of the greatest paper width h3, the distance g3 from the temperature sensor F11 is the shortest, as shown in FIG. 10. In the case of the paper sheet P4 of the second greatest paper width h4, the distance g4 from the temperature sensor F11 is the second shortest, as shown in FIG. 10. In the case of the paper sheet P5 of the smallest paper width h5, the distance g5 from the temperature sensor F11 is the longest, as shown in FIG. 10.

The outer diameter of the portions of the heating conveyance roller F101 that are in contact with the paper sheet and are close to the edges of the paper sheet determines the paper conveyance speed. That is, the conveyance speed varies with the paper widths (or the positions in the axial direction) of paper sheets being conveyed.

In the first modification, the contact portion temperature to be used in calculating thermal expansion of the heating conveyance roller F101 having a contact portion whose outer diameter varies with paper widths is estimated with the use of the correction coefficient that is set for each paper width of paper sheets being conveyed.

The outer diameter of the contact portion varies with paper widths, so as to cope with the paper widths. It should be noted that the paper width information may be manually input by an operator, or may be automatically determined at a time of conveyance. This paper width information is checked against a paper width table in which paper widths are associated with outer diameters and correction coefficients, and the contact portion outer diameter corresponding to the current paper width is obtained. The paper width table is stored in the storage unit 60.

Figure 11:
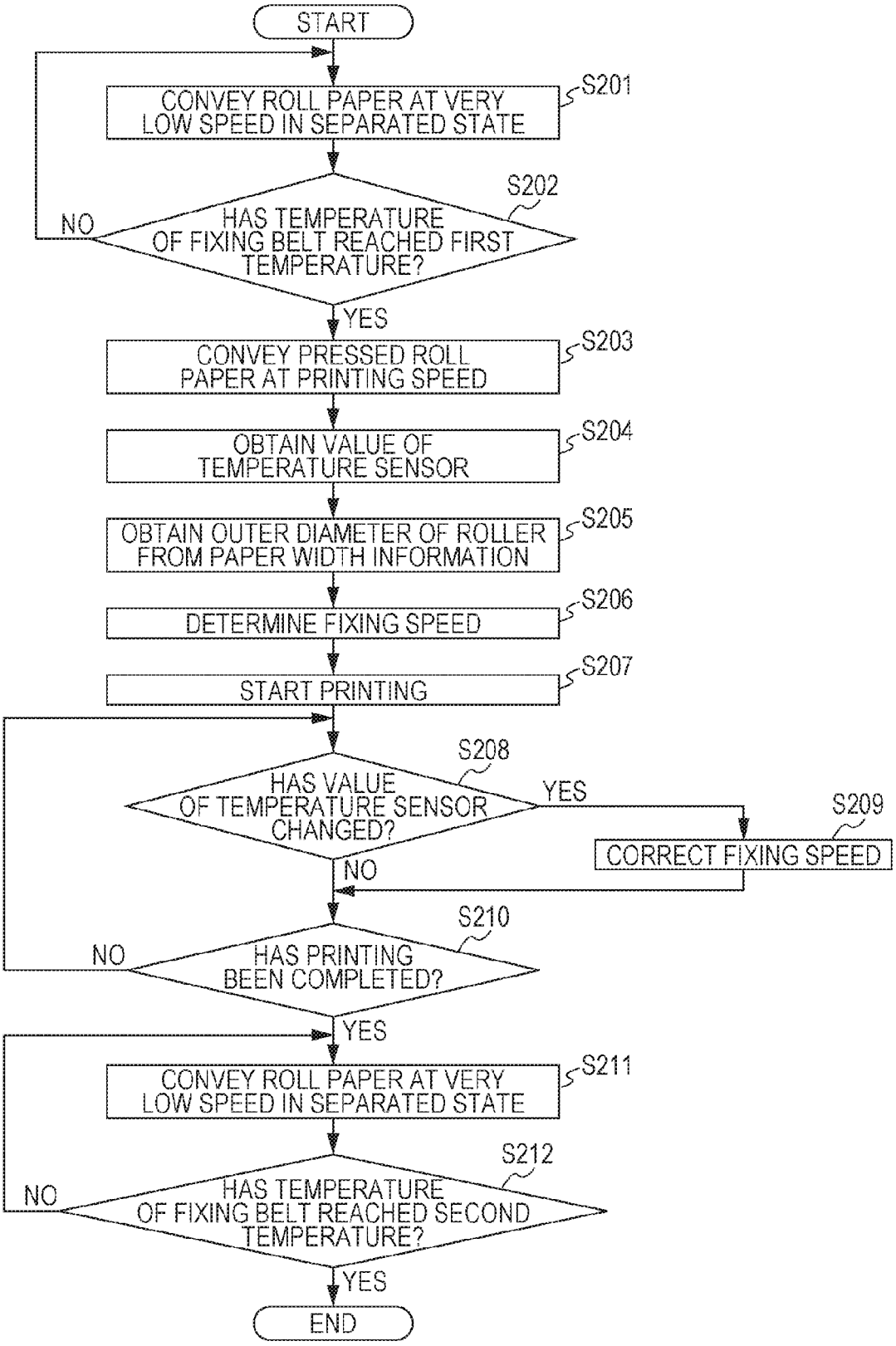
FIG. 11 is a flowchart showing an operation of an image forming apparatus according to the first modification.

Referring now to the flowchart in FIG. 11, the operation of the image forming apparatus 1 according to the first modification is described. In the first modification, an example case where an image is to be formed on roll paper (transfer paper) R supplied from the sheet feeder 1A is described, as in the above embodiment.

The procedures in steps S201 to S204 are the same as the procedures in steps S101 to S104 in FIG. 8 showing the operation of the image forming apparatus 1 according to the above embodiment, and therefore, explanation of them is not provided herein.

The control unit 100 then obtains the outer diameter of the contact portion of the heating conveyance roller F101 in contact with the paper sheet from the paper width information (step S205). Specifically, the control unit 100 obtains the outer diameter of the contact portion of the heating conveyance roller F101 in contact with the paper sheet, by referring to the paper width table stored in the storage unit 60.

The control unit 100 then determines the fixing speed (step S206). Specifically, the control unit 100 determines the fixing speed based on the value of the temperature sensor F11 obtained in step S204 and the outer diameter of the heating conveyance roller F101 obtained in step S205. In the first modification, the value of the roller diameter (specification value) Dn of the heating conveyance roller F1 in the mathematical formulas (1) to (4) used in the above embodiment is replaced with the value of the outer diameter of the heating conveyance roller F101 obtained in step S205.

The procedures in steps S207 to S212 are the same as the procedures in steps S106 to S111 in FIG. 8, and therefore, explanation of them is not provided herein.

As described above, in the image forming apparatus 1 according to the first modification, the heating conveyance roller F101 is formed in a crown shape having a contact portion whose outer diameter varies with paper widths, and the speed control unit further controls the rotation speed of the heating conveyance roller F101 based on the position of the contact portion in the axial direction.

Accordingly, with the image forming apparatus 1 according to the first modification, the paper sheet can be conveyed at a stable speed even in a case where the outer diameter of the contact portion varies with paper widths. Thus, adverse influence on the image can be reduced while a certain degree of freedom in designing the fixing device F is secured.

In the above described first modification, the heating conveyance roller F101 is formed in a reverse crown shape, and the fixing roller F201 is formed in a crown shape. However, the shapes of those rollers are not limited to them. For example, the heating conveyance roller F101 may be formed in a crown shape, and the fixing roller F201 may be formed in a reverse crown shape.

Alternatively, the heating conveyance roller F101 and the fixing roller F201 may have shapes other than crown shapes, as long as the heating conveyance roller F101 and the fixing roller F201 can form a pair.

(Other Modifications)

Although one print job is performed in the example case in the above described embodiment, the present invention is not limited to the above embodiment. For example, the present invention can also be applied in cases where two or more print jobs are successively performed.

Since there are no paper gaps in a long paper sheet such as the roll paper R, very slow conveyance is performed with the heating conveyance roller F1 being separated from the paper sheet after the end of printing, so that paper burning is restrained. As a result, in the axial direction, the portion of the heating conveyance roller F1 that is conveying the paper sheet has a low temperature, and the portions of the heating conveyance roller F1 that are not conveying the paper sheet have a high temperature. Therefore, a predetermined period of time is required before the temperature of the heating conveyance roller F1 is lowered to a uniform temperature in the axial direction.

Figure 12A:
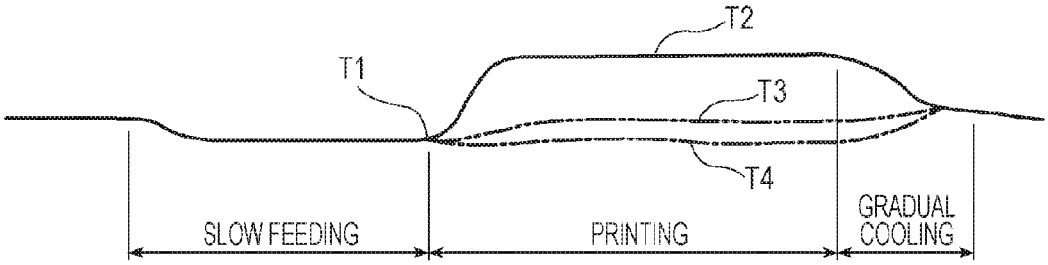
FIGS. 12A to 12C are diagrams showing changes in the temperatures of respective portions of the heating conveyance roller.
Figure 12B:
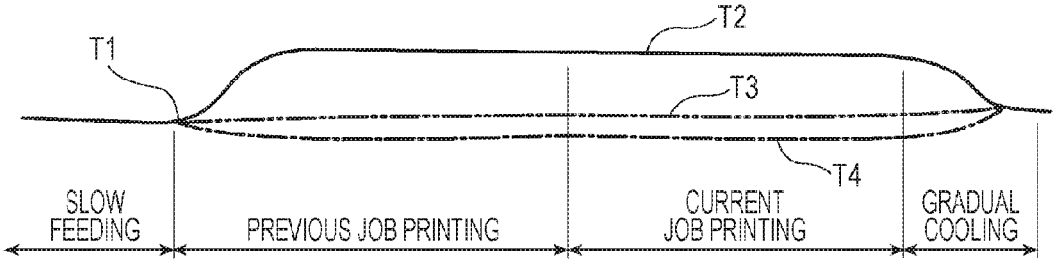
Figure 12C:
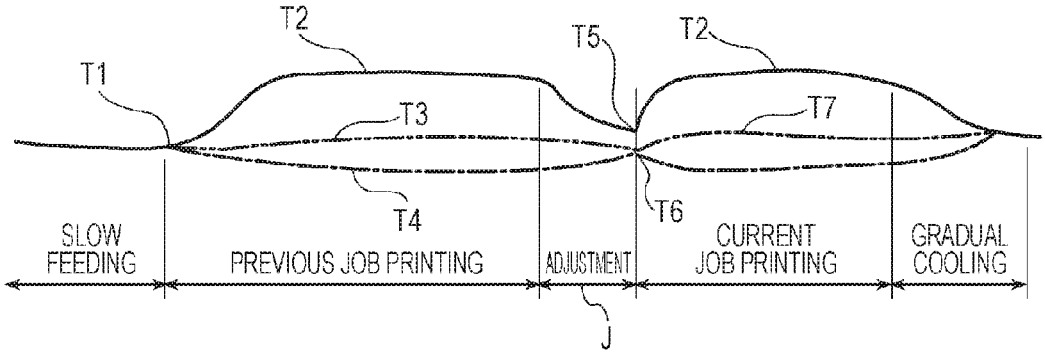

FIGS. 12A to 12C are diagrams showing changes in the temperatures of respective portions of the heating conveyance roller F1. In each of FIGS. 12A to 12C, the solid line indicates the obtained value of the temperature sensor F11, and T4 indicates the temperature of the paper portion during printing (the portion other than the contact portion in contact with the paper sheet).

A predetermined time required for cooling the heating conveyance roller F1 is set as the threshold value (100 seconds in this example). In a case where the time between successive jobs exceeds 100 seconds, the temperature of the heating conveyance roller F1 is uniform in the axial direction, and therefore, the jobs are regarded as successive but independent jobs. The value of the temperature sensor F11 continues to be used as the temperature of the contact portion in contact with the paper sheet at the start of printing (the printing start temperature T1), as shown in FIG. 12A. Where T2 represents the current temperature during the printing, the temperature T3 of the contact portion in contact with the paper sheet during the printing can be calculated according to the mathematical formula (5).

$$T3=T1+(T2-T1)/3 \quad \text{Mathematical formula (5):}$$

In a case where the time between the jobs is 0 seconds, or where the jobs are continuous, there is no change in the temperature between the previous job and the current job, as shown in FIG. 12B. Therefore, the two jobs are regarded as one job, and the temperature of the contact portion in contact with the paper sheet is also calculated according to the mathematical formula (5).

In a case where the time J between the successive jobs is equal to or shorter than 100 seconds, on the other hand, the temperature of the heating conveyance roller F1 is not uniform in the axial direction. Therefore, as shown in FIG. 12C, the temperature of the contact portion in contact with the paper sheet at the start of the printing (the printing start temperature T6 in the current job) is calculated by a method of calculating the temperature of the contact portion in contact with the paper sheet during the printing. Specifically, the printing start temperature T6 in the current job can be calculated by substituting the current temperature T2 during the printing in the mathematical formula (5) with the value T5 of the temperature sensor F11 at the start of the current print job (see the mathematical formula (6)).

$$T6=T1+(T5-T1)/3 \quad \text{Mathematical formula (6):}$$

That is, in a case where two or more print jobs are successively performed, and the time between the previous job and the current job is equal to or shorter than a predetermined time, the control unit 100 estimates the temperature T6 of the contact portion at the start of the current print job based on the temperature information T1 at the start of the previous print job and the temperature information T5 at the start of the current print job.

In this case, the temperature T7 of the contact portion in contact with the paper sheet during the current print job can be calculated according to the mathematical formula (7).

$$T7=T6+(T2-T6)/3 \quad \text{Mathematical formula (7):}$$

That is, in a case where two or more print jobs are successively performed, and the time between the previous job and the current job is equal to or shorter than a predetermined time, the control unit 100 estimates the temperature T7 of the contact portion during the current print job based on the temperature T6 of the contact portion at the start of the current print job and the current temperature information T2.

With this, the paper sheet can be conveyed at a stable speed, even if a print job is started in a situation where the temperature of the heating conveyance roller F1 is not uniform in the axial direction. Accordingly, there is no need to keep the standby time for cooling, and adverse influence on the image can be reduced while productivity of print jobs is maintained.

Although the rotation speed of the heating conveyance roller F1 is controlled based on the paper thickness information about the paper sheet in the above embodiment, the present invention is not limited to that. That is, the rotation speed of the heating conveyance roller F1 may be controlled without reference to the paper thickness information about the paper sheet.

Although the paper thickness information is obtained by referring to the paper thickness table in the above embodiment, the present invention is not limited to that. A paper thickness may be manually input by an operator for each paper sheet, or may be automatically determined at a time of conveyance, for example.

Although the rotation speed of the heating conveyance roller F1 is higher than the speed of the intermediate transfer belt T in the above embodiment, the present invention is not limited to that. The rotation speed of the heating conveyance roller F1 may be lower than the speed of the intermediate transfer belt T, or may be equal to the speed of the intermediate transfer belt T.

Although the roller diameter Dp during printing is calculated based on the difference between the temperature (T1×W) of the contact portion at the start of the printing and the current temperature (T2×W) of the contact portion (during the printing) in the above embodiment, present invention is not limited to that. For example, the roller diameter Dp during printing may be calculated based on the difference between the current temperature (T2×W) of the contact portion and the temperature (T21×W) of the contact portion estimated from the temperature T21 obtained by the temperature sensor F11 immediately before the acquisition of the current temperature T2 during printing. Where Dsa represents the roller diameter calculated at the time when temperature information is obtained immediately before the acquisition of the current temperature T2 during printing, the roller diameter Dp during printing can be calculated according to the mathematical formula (8).

$$Dp=Dsa+(T2-T21)\times W\times L \quad \text{Mathematical formula (8):}$$

As for the other specific structures and the other specific operations of the respective components of the image forming apparatus, changes may be made without departing from the scope of the invention.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

an intermediate transfer belt to which a toner image is transferred in a primary transfer process;

a transfer roller configured to transfer the toner image onto a long paper sheet in a secondary transfer process by following rotation of the intermediate transfer belt when pressed by the intermediate transfer belt; and a fixing device configured to fix the toner image transferred in the secondary transfer process by the transfer roller, onto the paper sheet;

a temperature estimating unit; and a speed control unit, wherein the fixing device includes:

a heating conveyance roller provided on a lower surface side of the paper sheet; and a fixing roller provided on an upper surface side of the paper sheet, the fixing roller facing the heating conveyance roller, when the paper sheet is made to pass through a nip portion formed by heating and pressing the heating conveyance roller and the fixing roller against each other, the paper sheet is heated and pressed, the toner image is fixed onto the paper sheet, and the paper sheet is conveyed toward a downstream side in a conveying direction, a contact-type temperature sensor is provided outside a paper conveyance width of the heating conveyance roller, the temperature estimating unit estimates a temperature of a contact portion of the heating conveyance roller in contact with the paper sheet based on temperature information obtained by the temperature sensor and paper width information about the paper sheet, and the speed control unit controls a rotation speed of the heating conveyance roller based on the temperature estimated by the temperature estimating unit.

2. The image forming apparatus according to claim 1, wherein the speed control unit estimates an outer diameter of the heating conveyance roller based on the temperature estimated by the temperature estimating unit, and controls the rotation speed of the heating conveyance roller based on the estimated outer diameter.

3. The image forming apparatus according to claim 1, wherein the temperature estimating unit estimates the temperature of a contact portion of the heating conveyance roller in contact with an edge of the paper sheet.

4. The image forming apparatus according to claim 1, wherein the heating conveyance roller is formed in a crown shape with the contact portion having an outer diameter varying with paper widths, and the speed control unit further controls the rotation speed of the heating conveyance roller based on a position of the contact portion in an axial direction.

5. The image forming apparatus according to claim 1, wherein the speed control unit further controls the rotation speed of the heating conveyance roller based on paper thickness information about the paper sheet.

6. The image forming apparatus according to claim 5, wherein the speed control unit acquires the paper thickness information by referring to a paper thickness table having paper types and basis weights associated with paper thicknesses.

7. The image forming apparatus according to claim 1, wherein, during image formation, the temperature estimating unit estimates the temperature of the contact portion based on the temperature information at a start of the image formation and the temperature information at the present time, when a plurality of jobs are successively performed in the image formation, and a time between a previous job and a current job is equal to or shorter than a predetermined time, the temperature estimating unit estimates the temperature of the contact portion at the start of the image formation based on temperature information at a start of image formation in the previous job and temperature information at the start of the image formation in the current job, and during the image formation in the current job, the temperature estimating unit estimates the temperature of the contact portion during the image formation in the current job based on the temperature of the contact portion at the start of the image formation in the current job and the temperature information at the present time.

8. The image forming apparatus according to claim 1, wherein the rotation speed of the heating conveyance roller is higher than a speed of the intermediate transfer belt.

9. A conveyance speed control method using the image forming apparatus according to claim 1, the conveyance speed control method comprising:

estimating the temperature of the contact portion of the heating conveyance roller in contact with the paper sheet based on the temperature information obtained by the temperature sensor and the paper width information about the paper sheet; and controlling the rotation speed of the heating conveyance roller based on the estimated temperature, wherein, during image formation, the temperature of the contact portion is estimated based on the temperature information at a start of the image formation and the temperature information at the present time.

* * * * *